US005669520A

United States Patent [19]

Simpson

[11] Patent Number: 5,669,520

[45] Date of Patent: Sep. 23, 1997

[54] FLEXIBLE NECK BABY BOTTLE

[76] Inventor: Bernice Simpson, P.O. Box 1031, Hillsborough, N.C. 27278

[21] Appl. No.: 622,579

[22] Filed: Mar. 25, 1996

[51] Int. Cl.[6] ..... A61J 9/00; A61J 11/00; B65D 23/10

[52] U.S. Cl. ..... 215/11.1; 215/382; 215/384; 215/900

[58] Field of Search ..... 215/11.1–11.6, 215/382–384

[56] References Cited

U.S. PATENT DOCUMENTS

| | | | |
|---|---|---|---|
| 2,424,629 | 7/1947 | Patterson | 215/11.1 |
| 2,780,378 | 2/1957 | Romano | 215/11.1 |
| 2,885,104 | 5/1959 | Greenspan | 215/11.1 X |
| 3,549,036 | 12/1970 | Ritsi | 215/11.6 |
| 4,759,453 | 7/1988 | Paetzold | 215/11.1 |
| 4,813,556 | 3/1989 | Lawrence | 215/11.1 X |
| 4,925,042 | 5/1990 | Chong | 215/11.1 |
| 4,969,564 | 11/1990 | Cohen et al. | 215/11.1 |
| 4,994,076 | 2/1991 | Goss | 215/11.1 X |
| 5,190,174 | 3/1993 | Klag | 215/11.1 |
| 5,551,583 | 9/1996 | Sachathamakul et al. | 215/11.1 X |

FOREIGN PATENT DOCUMENTS

| | | | |
|---|---|---|---|
| 595835 | 2/1978 | Switzerland | 215/11.1 |

*Primary Examiner*—Sue A. Weaver
*Attorney, Agent, or Firm*—Michael I. Kroll

[57] ABSTRACT

A flexible neck baby bottle (10) comprises a nursing container (12) having a neck (14) at an open end, to hold a liquid therein. A nipple assembly (16) is adapted to be received in a mouth (18) of a baby (20). A structure (22) is for mounting in a watertight sealed manner the nipple assembly (16) to the neck (14) of the nursing container (12). A facility (24) in the nursing container (12) directly below the neck (14), is for allowing bending of the neck (14) with the mounting structure (22) and the nipple assembly (16) freely in any direction without inhibiting a flow of the liquid from the nursing container (12) out through the nipple assembly (16) and into the mouth (18) of the baby (20), so that the baby can easily maneuver and orient the nipple assembly (16) at any angle when nursing.

1 Claim, 2 Drawing Sheets

FLEXIBLE NECK BABY BOTTLE

BACKGROUND OF THE INVENTION

1. Field of the Invention

The instant invention relates generally to infant feeding devices and more specifically it relates to a flexible neck baby bottle.

2. Description of the Prior Art

Numerous infant feeding devices have been provided in prior art. For example, U.S. Pat. Nos. 4,925,042 to Chong; 4,969,564 to Cohen et al.; 4,994,076 to Guss and 5,190,174 to Klag all are illustrative of such prior art. While these units may be suitable for the particular purpose to which they address, they would not be as suitable for the purposes of the present invention as heretofore described.

CHONG, RAY

Independent Infant Bottle Feeding Ensemble

U.S. Pat. No. 4,925,042

A versatile feeding device comprising a receptacle having a lip. A lid is complementary with the lip and has a first aperture formed therein. A tubular handle supports a nipple and is of such a rigidity as to support the receptacle in different positions during feeding. The tubular handle provides a passage for fluid communication between the first aperture and the nipple. A mounting flange on the lip of the bottle is for holding the tubular handle for movement relative to the lid about a transverse axis. A guide portion with an abutment surface is for coaxially receiving the tubular handle and is mounted on the bottle lip to hold the tubular handle in a second position for limited movement about the transverse axis. To eliminate the need for anyone to hold the receptacle, a clamp is provided on an outer surface of the receptacle, for attachment of the receptacle to an anchored object. Also disclosed is a kit for use on a feeding device.

COHEN, JOEL

COHEN, ESTHER R.

Baby Bottle With Nipple and Flexible Straw

U.S. Pat. No. 4,969,564

A baby bottle assembly having a nipple which is mounted on a flexible straw extending from the bottle. In the preferred embodiment, the straw is disposed within the interior of the bottle with a substantial portion of the straw extending exteriorly of the bottle. A nipple structure is mounted on the end, such that a baby can feed from the bottle in an upright position without the need of having to invert the bottle to facilitate fluid flow to the nipple. A one-way valve structure is mounted on the end of the straw within the nipple assembly to permit fluid flow in an outward direction from the bottle while preventing air from entering the bottle through the flexible straw.

GUSS, BARRON

Infant Nursing Device

U.S. Pat. No. 4,994,076

An infant nursing device for permitting an infant to ingest by means of a nipple a liquid contained in a nursing bottle remote from the nipple includes a closure for the nursing bottle. The closure has a conduit passing through it. A nipple holder is for holding the nipple with a liquid-tight seal. The nipple holder has a conduit through it communicating between the exterior and the interior of the nipple. A segment of flexible tubing one end of which is connected to the end of the closure conduit is inside the bottle when the closure is on the bottle. The other end which is preferably weighted, approximately reaches the bottom of the bottle, when the closure is on the bottle. Another segment of flexible tubing one end of which is connected to the end of the closure conduit is outside the bottle, when the closure is on the bottle. The other end is connected to the end of the nipple holder conduit which is exterior to the nipple. Together with the nursing device, there may be included a device for cleaning the nursing device.

KLAG, ROBERT W.

Swivel Teat for Baby Bottle

U.S. Pat. No. 5,190,174

An infant feeding apparatus comprising a feeding bottle having a nipple or teat which has a corrugated swivel portion. This enables the teat to bend freely between the bottle's neck and the end of the teat, without restricting beverage flow through the teat.

SUMMARY OF THE INVENTION

A primary object of the present invention is to provide a flexible neck baby bottle that will overcome the shortcomings of the prior art devices.

Another object is to provide a flexible neck baby bottle, whereby the flexible neck will allow a baby while nursing to maintain a more erect posture, so that the baby can continue to nurse from the bottle no matter what angle the head of the baby is placed in with relationship to the bottle.

An additional object is to provide a flexible neck baby bottle, in which the bottle has finger grip grooves for a better grip and is fabricated out of a lightweight shatterproof pliable plastic material making the bottle safer to handle by the baby.

A further object is to provide a flexible neck baby bottle that is simple and easy to use.

A still further object is to provide a flexible neck baby bottle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
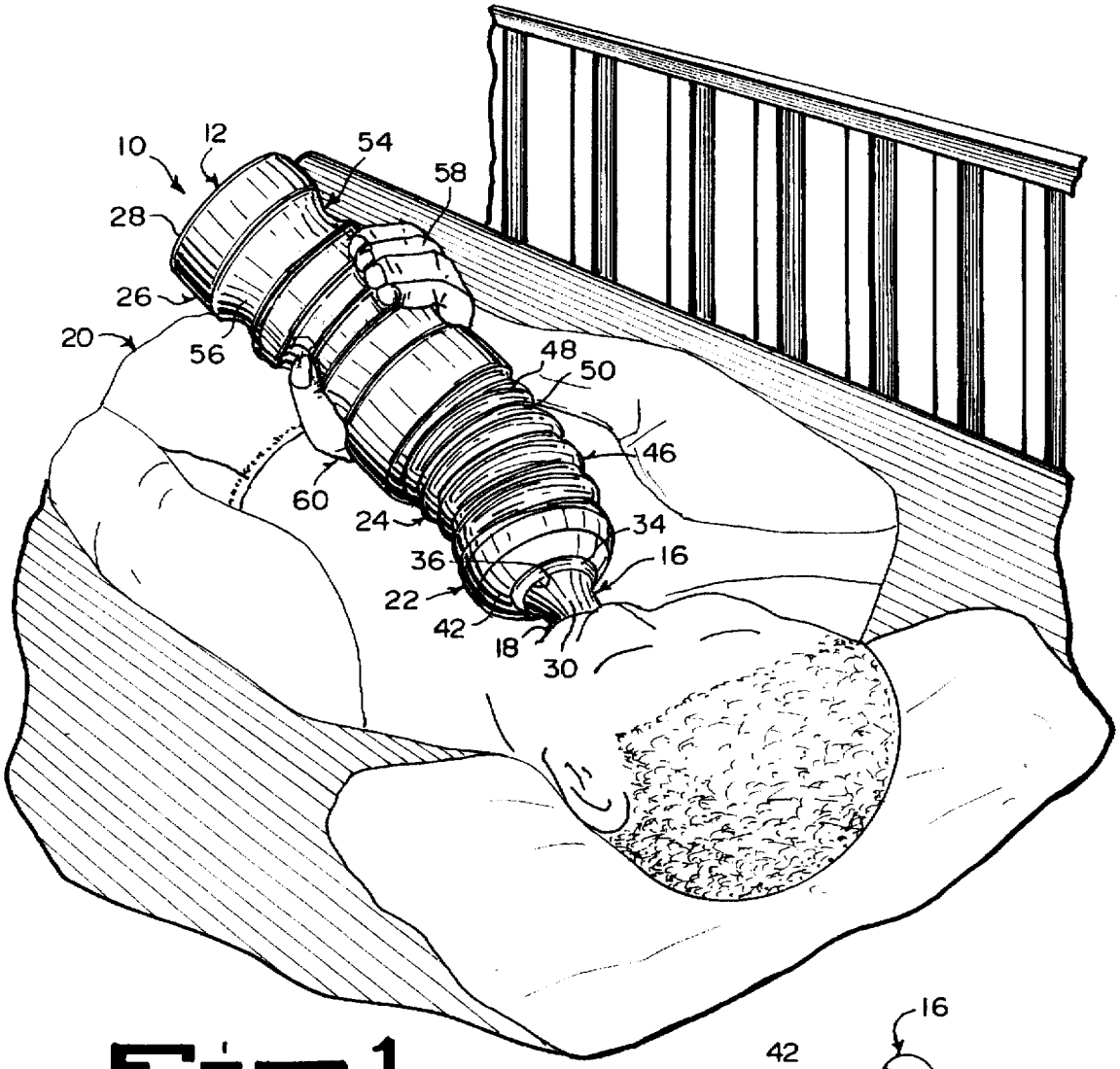
FIG. 1 is a perspective view of a baby in a crib holding the instant invention and nursing therefrom.
Figure 2:
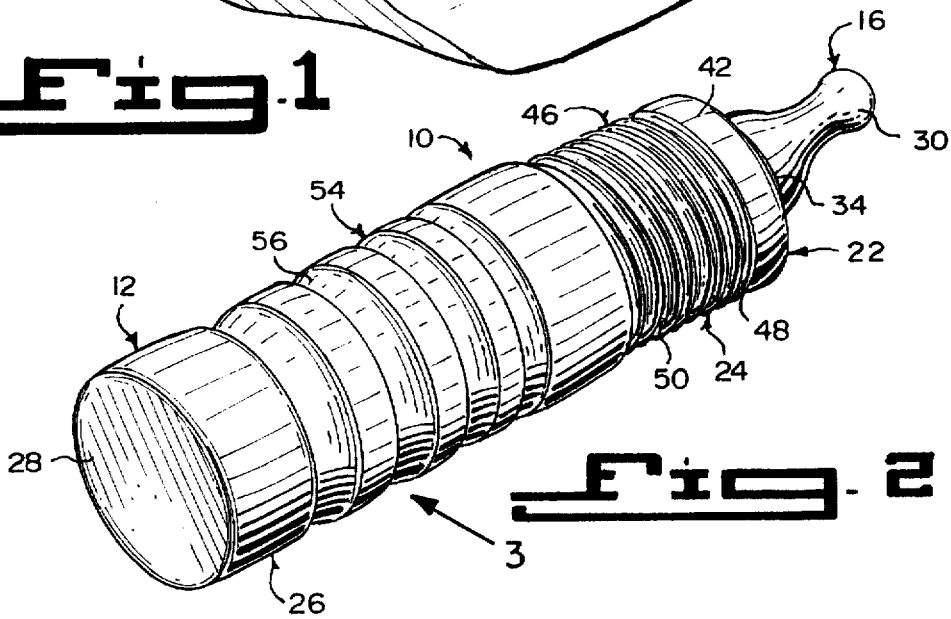
FIG. 2 is a perspective view of the instant invention per se.
Figure 3:
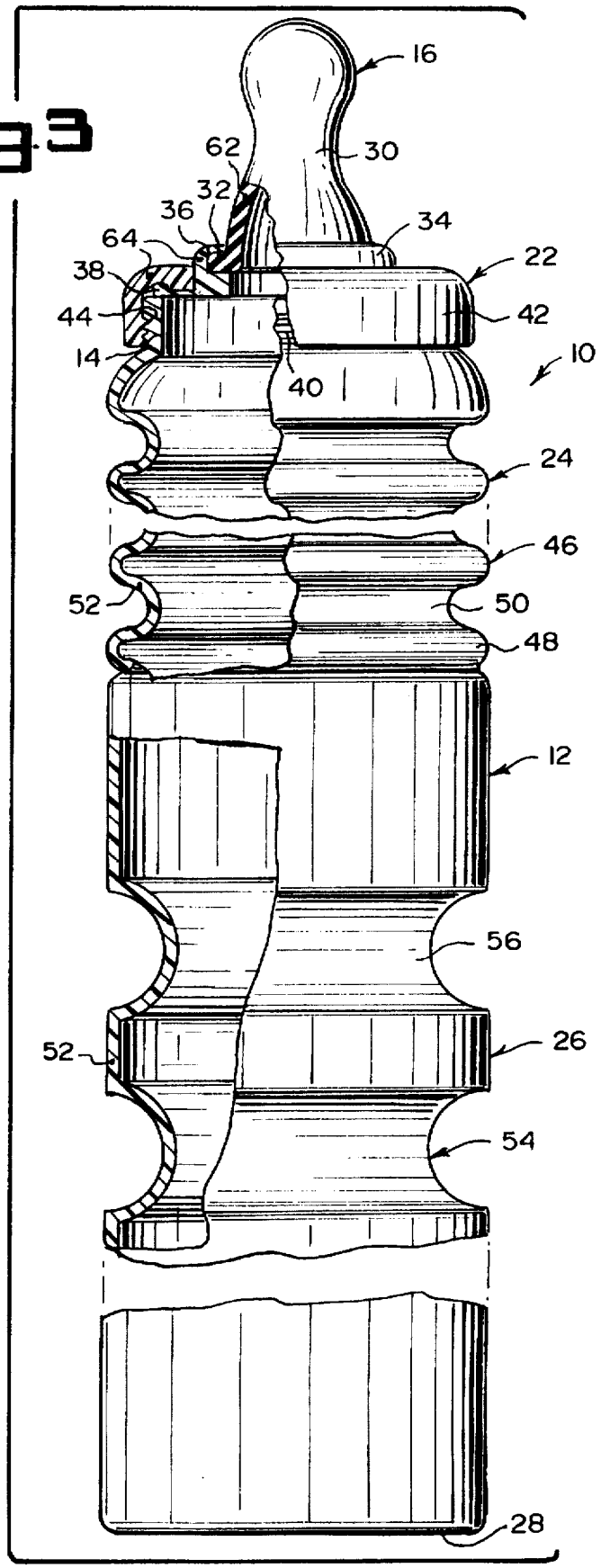
FIG. 3 is an enlarged elevational view taken in the direction of arrow 3 in FIG. 2, with parts broken away and in section, showing the various components of the instant invention in greater detail.

Turning now descriptively to the drawings, in which similar reference characters denote similar elements throughout the several views, FIGS. 1 through 3 illustrate a flexible neck baby bottle 10, comprising a nursing container 12 having a neck 14 at an open end, to hold a liquid therein. A nipple assembly 16 is adapted to be received in a mouth 18 of a baby 20. A structure 22 is for mounting in a watertight sealed manner the nipple assembly 16 to the neck 14 of the nursing container 12. A facility 24 in the nursing container 12 directly below the neck 14, is for allowing bending of the neck 14 with the mounting structure 22 and the nipple assembly 16 freely in any direction without inhibiting a flow of the liquid from the nursing container 12 out through the nipple assembly 16 and into the mouth 18 of the baby 20, so that the baby can easily maneuver and orient the nipple assembly 16 at any angle when nursing.

The nursing container 12 consists of a cylindrical body 26 having a flat base 28. The nipple assembly 16 includes an artificial teat 30 having an annular lip 32. A connector 34 has an annular socket 36 and a flange 38 thereabout. The annular socket 36 will receive the annular lip 32 of the artificial teat 30 in a watertight sealed manner.

The mounting structure 22 comprises the neck 14 of the nursing container 12 having external threads 40. An annular cap nut 42 has internal threads 44 to engage with the external threads 40 on the neck 14. When the annular cap nut 42 is tightened, the annular flange 38 on the connector 34 of the nipple assembly 16 will be clamped onto a rim of the neck 14. The bending facility 24 is a corrugated circular bellows 46.

The corrugated circular bellows 46 includes a plurality of annular ridges 48 with a plurality of annular recesses 50 between the annular ridges 48. The corrugated circular bellows 46 is made out of a soft pliable plastic material 52, so as to be expandable and compressible when bent.

The flexible neck baby bottle 10 further contains a configuration 54 in the nursing container 12 directly below the bending facility 24, for allowing a better gripping of the nursing container 12. The better gripping configuration 54 consists of a plurality of annular grooves 56 formed in the nursing container 12, to receive the fingers 58 of a hand 60 of the baby 20.

For best results the artificial teat 30 is typically made out of rubber. The connector 34 and the annular cap nut 42 is typically made out of a rigid plastic. The neck 14, the corrugated circular bellows 46, the cylindrical body 26 and the annular grooves 56 are all integral and can be made out of the soft pliable plastic material 52.

OPERATION OF THE INVENTION

To use the flexible neck baby bottle 10, the following steps should be taken:

1. Insert the annular lip 32 of the artificial teat 30 into the annular socket 36 of the connector 34 in a watertight sealed manner.
2. Push the artificial teat 30 through the annular cap nut 42, so that the connector 34 rests therein.
3. Fill the nursing container 12 through its neck 14 with nursing fluid, such as formula, milk, juice, etc.
4. Place the annular cap nut 42 over the neck 14.
5. Engage the internal threads 44 of the annular cap nut 42 with the external threads 40 on the neck 14.
6. Tighten the annular cap nut 42, so that the annular flange 38 on the connector 34 will be clamped onto the rim of the neck 14.
7. Allow the baby 20 to grasp the annular grooves 56 on the nursing container.
8. Bend the corrugated circular bellow 46 when the artificial teat 30 is in the mouth 18 of the baby 20, so that the baby 20 can easily maneuver and orient the nipple assembly 16 with respect to the cylindrical body 26 of the nursing container 12.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A flexible neck baby bottle comprising:

a) a nursing container having a neck at an open end, to hold a liquid therein;

b) a nipple assembly adapted to be received in a mouth of a baby comprising an artificial teat having an annular lip and a cylindrical connector having an annular socket at one end to receive said annular lip of said teat and a flange at the other end of said connector;

c) means for mounting in a watertight sealed manner said nipple assembly to said neck of said nursing container comprising external threads on said neck, an annular cap nut having internal threads at one end of said nut for engaging said external threads and the opposite end of said nut having means for clamping the flange of said connector onto a rim of said neck as said annular cap nut is tightened on the neck of said nursing container;

d) means in said nursing container directly below said neck for allowing bending of said neck by the baby with said mounting means and said nipple assembly freely in any direction without inhibiting a flow of the liquid from said nursing container out through said nipple assembly and into the mouth of the baby comprising a corrugated circular bellows integral with said nursing container between said cylindrical body and said neck, said bellows including a plurality of annular, circular ridges with a plurality of annular, circular recesses between said annular ridges made out of a plastic sufficiently soft and pliable to permit both bending in any direction by movement of the baby as well as compression and expansion when bent, so that the baby can easily maneuver and orient said nipple assembly at any angle when nursing; and e) means in said nursing container directly below said bending means comprising a plurality of annular grooves formed in said nursing container to receive the fingers of a hand of the baby for allowing a better gripping of said nursing container.

* * * * *